US005829968A

United States Patent [19]

Lonardi et al.

[11] Patent Number: 5,829,968

[45] Date of Patent: Nov. 3, 1998

[54] CHARGING DEVICE FOR A SHAFT FURNACE

[75] Inventors: Emile Lonardi; Gilbert Bernard; Marc Solvi; Guy Thillen, all of Luxembourg, Luxembourg

[73] Assignee: Paul Wurth S.A., Luxembourg, Luxembourg

[21] Appl. No.: 646,361

[22] PCT Filed: Nov. 17, 1994

[86] PCT No.: PCT/EP94/03815

§ 371 Date: Jun. 27, 1996

§ 102(e) Date: Jun. 27, 1996

[87] PCT Pub. No.: WO95/14793

PCT Pub. Date: Jun. 1, 1995

[30] Foreign Application Priority Data

Nov. 23, 1993 [LU] Luxembourg ..... 88429

[51] Int. Cl.[6] ..... F27D 1/08

[52] U.S. Cl. ..... 432/95; 432/98; 414/203; 266/184

[58] Field of Search ..... 432/95, 96, 97, 432/98, 99, 100, 101, 102; 414/203; 266/184

[56] References Cited

U.S. PATENT DOCUMENTS

| | | | |
|---|---|---|---|
| 1,717,828 | 6/1929 | Baker . | |
| 3,606,040 | 9/1971 | Euteneuer | 414/203 |
| 3,799,369 | 3/1974 | Mahr | 266/184 |
| 4,568,271 | 2/1986 | Mallek | 432/95 |
| 4,728,240 | 3/1988 | Mahr et al. | 266/184 |
| 4,822,229 | 4/1989 | Legille et al. | 434/95 |
| 4,878,655 | 11/1989 | Henneken et al. . | |
| 4,881,869 | 11/1989 | Henneken et al. . | |
| 5,046,908 | 9/1991 | Cimenti et al. | 414/203 |

FOREIGN PATENT DOCUMENTS

| | | | |
|---|---|---|---|
| 1456819 | 9/1966 | France . | |
| 2187543 | 9/1987 | United Kingdom | 432/98 |
| 2224723 | 5/1990 | United Kingdom . | |
| WO 95/14793 | 6/1995 | WIPO . | |

*Primary Examiner*—Henry A. Bennett
*Assistant Examiner*—Gregory A. Wilson
*Attorney, Agent, or Firm*—Fishman, Dionne, Cantor & Colburn

[57] ABSTRACT

A charging device for a shaft furnace with a lower bell comprises lower means of blockage allowing an upper hopper to be isolated in a sealed manner from a lower hopper and allowing the retention of the charging material. In their open position, these lower means of blockage are positioned so that they unblock a free central passage for the flux of material. This flux is established in the form of a compact and focused flux. Means for moving the lower bell are positioned so as not to disturb the focusing of this flux. Positioned above the lower bell is a deflecting surface, which causes the focused flux to diverge with axial symmetry. Inter alia, a better symmetry in the filling of the lower hopper is obtained.

14 Claims, 6 Drawing Sheets

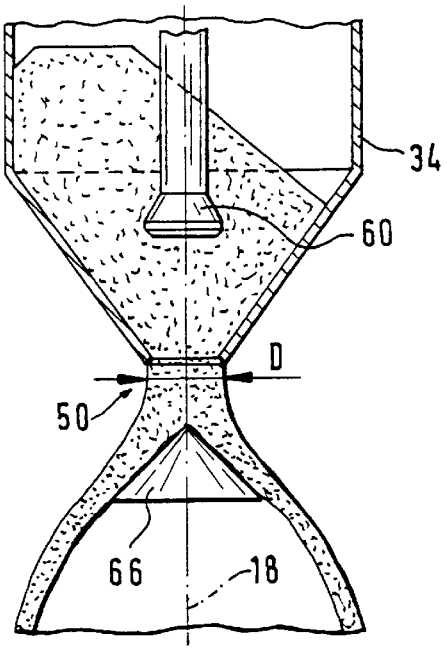
Fig. 3A
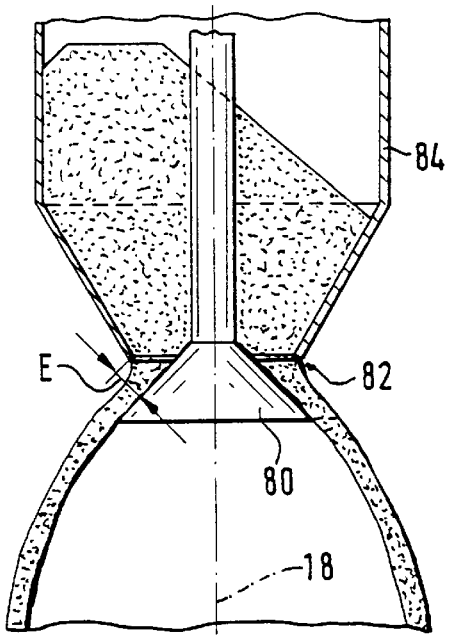
Fig. 4A
Fig. 3B
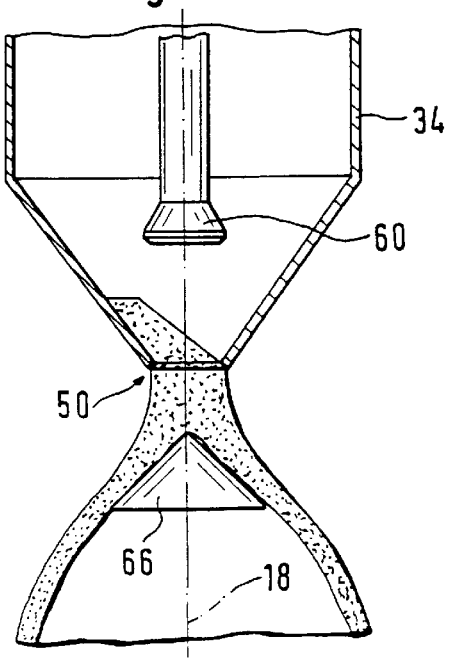
Fig. 4B
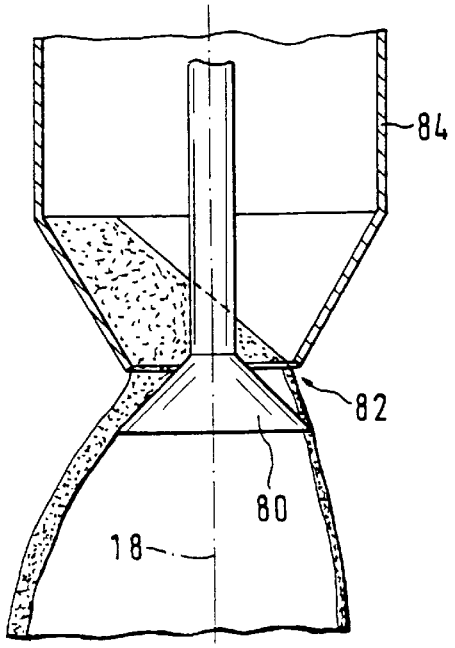

CHARGING DEVICE FOR A SHAFT FURNACE

The invention relates to a charging device for a shaft furnace. More particularly, it relates to a charging device for a shaft furnace comprising two superposed hoppers, the lower hopper of which is equipped with a bell capable, in a closed position, of blocking the opening for the discharge of the lower, hopper into the shaft furnace and, in an open position, of distributing the charging material over the surface of the charge.

Conventional charging devices for a shaft furnace, particularly a blast furnace, generally comprise a lower bell of large diameter and an upper bell of smaller diameter. The two bells are fitted into a lower hopper which forms a charging chamber for the shaft furnace. The large bell provides for the sealing off from the shaft furnace and for the distribution of the charging material over the surface of the charge. The small bell provides for the sealing off from an upper hopper which is in direct communication with the atmosphere.

This upper hopper, which is fed by skip elevators, is normally a rotating hopper in order to ensure a more symmetrical feeding of the charging chamber. In fact, it is known that the charging of a static hopper by skip elevators, off-set from the axis of the blast furnace, produces very asymmetrical charging profiles in this hopper, which entails an asymmetrical charging of the charging chamber and hence an asymmetrical distribution of the charging material by the large bell over the surface of the charge in the shaft furnace. Now, it is known that deviations from symmetry in the charge in the shaft furnace have harmful repercussions on the functioning of this furnace.

These conventional charging devices have the disadvantage that the lower bell inadequately fulfills its function as a lower sealing device for the charging chamber. In fact, because of the large diameter of the lower bell and of abrasion by the charging material flowing along the lower bell, it is almost impossible to provide for a durable seal between the lower bell and its seating formed try the lower edge of the charging chamber.

In order to rectify this lack of sealing, it has been proposed to duplicate the charging chamber. In other words, it has been proposed that the rotating upper hopper should be made in the form of a closed vessel, which can be isolated from the atmosphere by using upper sealing valves. A device of this type is described, for example, in the patent specifications US-A-4,878,655 and US-A-4,881,869.

According to these two US patent specifications, the lower bell is suspended from a rod positioned along the axis of the shaft furnace. The upper hopper is suspended above the lower hopper in such a way that it can be driven in rotation around the axis of the shaft furnace. A first sealed rotating joint is provided for this purpose between the lower hopper and the upper hopper. At its upper end, the upper rotating hopper is connected in a sealed manner, using a second sealed rotating joint, to a fixed cap fitted with two feeding tanks for skip elevators. These feeding tanks are fitted with upper sealing valves. The lower means for blocking off the rotating hopper essentially comprise a bell which can be moved along the is axis of the furnace below the rotating hopper, between an upper position blocking a discharge opening, and a lower position, in which it unblocks an annular discharge opening and is located directly in the flux of material. For this purpose, the upper bell is suspended from a sleeve surrounding the suspension rod for the lower bell. It simultaneously fulfills a function as a material retention device add a sealing device between the upper rotating hopper and the lower fixed hopper and also forms, in the open position, at the discharge opening, a kind of radial expansion device for the flux of material flowing from the upper hopper into the lower hopper.

The charging device described above makes it possible in a natural way, thanks to its upper rotating hopper, to avoid large deviations from symmetry in the charge in the shaft furnace. However, it does not enable sealing problems to) be satisfactorily solved, particularly if the shaft furnace is operating at high pressures.

The aim of the present invention is to propose a charging device for a shaft furnace, with two superposed hoppers and a lower bell (or large bell) making it possible to reduce the effect of an asymmetrical charging of the upper hopper on the distribution of the charging material by the lower bell, while creating more favourable preconditions for achieving a tightly sealed blockage between (the upper hopper and the lower hopper.

In conformity with the present invention, this aim is achieved by a device for a shaft furnace comprising a lower hopper defining a discharge opening above a surface of the charge in the shaft furnace, a lower bell having a blocking position in which it blocks off said discharge opening of the lower hopper and an open position in which it is located vertically below said discharge opening, means for vertically displacing the lower bell from its blocking position to its open position and vice versa, an upper hopper installed above said lower hopper and connected, in a sealed manner to the latter, lower means of blockage connected between the lower hopper and the upper hopper and having a blocking position. in which they isolate the upper hopper in a sealed manner from the lower hopper and retain the charging material in the upper hopper, and an open position, in which they allow communications between the upper hopper and the lower hopper and unblock a flux of material flowing from the upper hopper to the lower hopper, at least one material feeding device for the upper hopper mounted above the latter, this feeding device being in communication on one side with the atmosphere and on the other side with said upper hopper, at least one upper sealing device connected between said feeding devices and the upper hopper, in order to be able to isolate the latter in a sealed manner from the atmosphere, characterised in that, in their open position, said lower means of blockage connected between the lower hopper and the upper hopper are positioned in such a way that they unblock a free central passage substantially coaxial with the axis of the shaft furnace for the flux of material, so that this flux is established below the upper hopper in the form of a compact flux of material, in that said means for vertically displacing the lower bell are positioned outside the space occupied by said compact flux of material, and in that, positioned above the lower bell, is a surface for deflecting the compact flux of material so as to make the latter diverge above the lower bell.

It is important to note that the lower means of blockage, connected between the lower hopper and the upper hopper, are so positioned that, in their lower aspen position, they unblock a free central passage substantially coaxial with the axis of the shaft furnace, so that the flow of material is established in the form of a compact and focused flux of material below the upper hopper. In additions the means for moving the lower bell vertically are positioned outside the space occupied by this compact flux of material. A deflecting surface is positioned in the trajectory of the compact flux of material, above the lower bell at a place where the focusing of the flux of material ends or virtually ends. This deflecting surface causes the flux focused above the lower bell to diverge or disperse.

In the charging device according to the invention, the lower means of blockage, in their open position, unblock a central free passage substantially coaxial with the axis of the furnace. In this way, a compact flux of material is established between the upper hopper and the lower hopper, which is less affected by asymmetries in the profile of the charge in the upper hopper than a radially expanded flow. It will in fact be appreciated that this central flow from the upper hopper causes the trajectories of the particles of material to converge around the axis of the shaft furnace and, through this focusing of the particle trajectories, tends to lessen the initial asymmetries in the spatial distribution of the particles of material. The smaller the apex angle of the cone of flow from the upper hopper, the better will be the result of the focusing obtained.

It is recalled that in previous devices, the blocking bell, which is located directly below a discharge opening, causes instead an immediate expansion of the flux of material and thus makes the trajectories of the particles of material diverge from their preliminary acceleration by gravity. A focusing of the trajectories around the central axis cannot be produced and the immediate expansion of the flux tends to accentuate the initial asymmetries in the spatial distribution of these particles of material around the central axis.

It will also be appreciated that the cross-section of the discharge in a compact central flow has a smaller perimeter than the cross-section of the discharge in an expanded annular flow. Now, the perimeter of this discharge cross-section directly determines the minimum length of the joint between the upper hopper and the lower sealed blocking element. In other words, the joint, which must be a sealed joint, may be shorter in the case of a central discharge opening than in the case of an annular discharge opening. In this context, it should be more particularly noted that the smallest possible dimension of a discharge opening must necessarily be a multiple (k) of the largest dimension of the particles of material to be discharged (DMAX). In the case of an annular discharge opening, for example between a sealing bell and the lower edge of the upper hopper, it is the width of this annular space which must be at least equal to (k*DMAX). In the case of a central discharge opening, circular for example, it is the diameter of this central discharge opening which must be at least equal to (k*DMAX). It follows that the cross-section of the circular passage may be much smaller than the cross-section of the annular passage; which means that the perimeter of the cross-section of the circular passage may be considerably less than the perimeter of the cross-section of the annular passage, hence providing a better solution to the problems of the sealed blockage at the level of the communication between the lower hopper and the upper hopper.

Another advantage of the device according to the invention is that, in their respective open position, the lower means of blockage are located outside said axial passage in which the flux of material is established in the form of a compact flux of material. It follows that these means of blockage, and particularly the surfaces providing the sealing on these means of blockage, are not subjected to abrasive wear by the compact flux of material flowing from the upper hopper.

Because the means for moving the lower bell vertically are also positioned outside the space occupied by the compact flux of material, the convergence of the particle trajectories around the axis of the shaft furnace is not disturbed by any element of the proposed charging device before striking the deflecting surface. Consequently, it is a focused compact flux which strikes the deflecting surface located above the lower bell. The essential function of this deflecting surface its to cause the focused compact flux of material to disperse or diverge above the bell and to distribute the material with axial symmetry on the lower bell. This deflecting surface can then be specially designed for this function, disregarding all additional constraints. The geometry of this surface can thus be chosen in such a way as to favour, for example, a dispersal with axial symmetry of the compact flux of material. In addition, the mechanical structure supporting this surface and the materials used for its construction can be adapted to the specific requirements resulting solely from its function as a deflecting surface, without having to find compromises as regards additional functions (like for example the blocking and sealing functions).

The lower means of blockage connected between the lower hopper and the upper hopper could of course comprise a single blocking device, which provides both for the retention of material in the upper hopper and for the sealing between the lower hopper and the upper hopper. Most frequently, it is preferable, however, for these lower means of blockage to comprise a sealing device located downstream from a material retention device. In order to discharge the upper hopper into the lower hopper, the sealing device is first moved into its open position, outside said free central passage for the compact flux of material, before moving the material retention device into its respective open position. It follows that the sealing device is already in its open position when the flux of material begins to flow. The sealing device is therefore never in contact with the material flowing from the upper hopper.

The sealing device advantageously comprises a flexible sealing joint. With such a sealing device with a flexible joint, the sealing obtained is far superior to that obtained with a conventional bell, which necessarily involves sealing of: the metal-on-metal type. This improved sealing makes it possible to operate at higher pressures in the shaft furnace, without thereby increasing leaks at the charging device. It will be appreciated that a charging device with a lower bell is thus created which, for the first time, incorporates a charging chamber capable of being truly described as sealed off from the shaft furnace. Such an efficient sealing of the upper hopper from the shaft furnace in particular makes possible a controlled purging of the gases in the latter when the lower and upper sealing devices are closed. This is a considerable advantage in view of the ever stricter requirements as regards environmental pollution.

The sealing device is preferably, but not necessarily, a sealing valve installed below the upper hopper. Such a valve has, inter alia, the advantage of being more easily accessible and removable.

This sealing valve advantageously comprises:

a blocking device, a seating associated with this blocking device, this seating being connected in a sealed manner to said upper hopper and surrounding, at the periphery, the space occupied by said full flux of material, means for moving the blocking device between a lateral position in which it is located outside said space occupied by the compact flux of material, and a blocking position in which it is located opposite its seating, and means for applying the blocking device in its blocking position firmly on to its seating.

In a first preferred implementation said material retention device comprises several blocking devices symmetrical with respect to the furnace axis and means for moving these blocking elements symmetrically with respect to the furnace axis so as to create a central opening around the furnace axis. It follows that the flux of material in the form of a compact flux is, from the outset, coaxial with the furnace axis and that the cross-section of the passage for the material may be modified.

The material retention device may, however, also comprise a blocking bell which can be moved inside the hopper between a lower position blocking a discharge opening and a raised upper position, in which it unblocks said discharge opening. In the raised position, this bell advantageously affects the homogeneity of the flow of material inside the hopper. In particular, in this raised position, it reduces the phenomenon of the segregation of solid particles according to their particle size.

The deflecting surface advantageously forms a cone of revolution whose apex is directed towards the upper hopper and whose axis is coaxial with the axis of the full flux of material. This shape for the deflecting surface causes a progressive dispersal of the compact flux and favours the establishment of an axial symmetry for the trajectories of the deflected particles taken as a whole.

In order to promote even further the establishment of this axial symmetry, the cone of revolution is advantageously equipped with guide fins which extend from the apex to the base of the cone so as to define flow channels for the material along the latter.

In order to correct for residual asymmetries in the charging of the lower hopper, the deflecting surface may be supported at a point above the lower bell so as to be able to alter, from outside the furnace, its positioning in the compact flux of material. Thus, it is possible to use, for example, a cone of revolution which is supported so that a horizontal movement can be imposed on it. It would, however, be possible also to use a cone of revolution which is supported so that a variable inclination can be imposed on it from outside the furnace. For the same purpose it is of course also possible to use a deflecting surface which is supported above the lower bell so that it can rotate about the furnace axis.

Additional advantages and features will emerge from the detailed description of the preferred embodiments of the invention, described below as illustrative examples, by referring to the appended drawings in which:

FIGS. 3A and 3B are two diagrammatic representations of the flow of the material from the upper hopper into the lower hopper, in a charging device for a shaft furnace according to the invention;

FIGS. 4A and 4B are two diagrammatic representations of the flow of the material from the upper hopper into the lower hopper, in a device according to the present state of the art;

Figure 1:
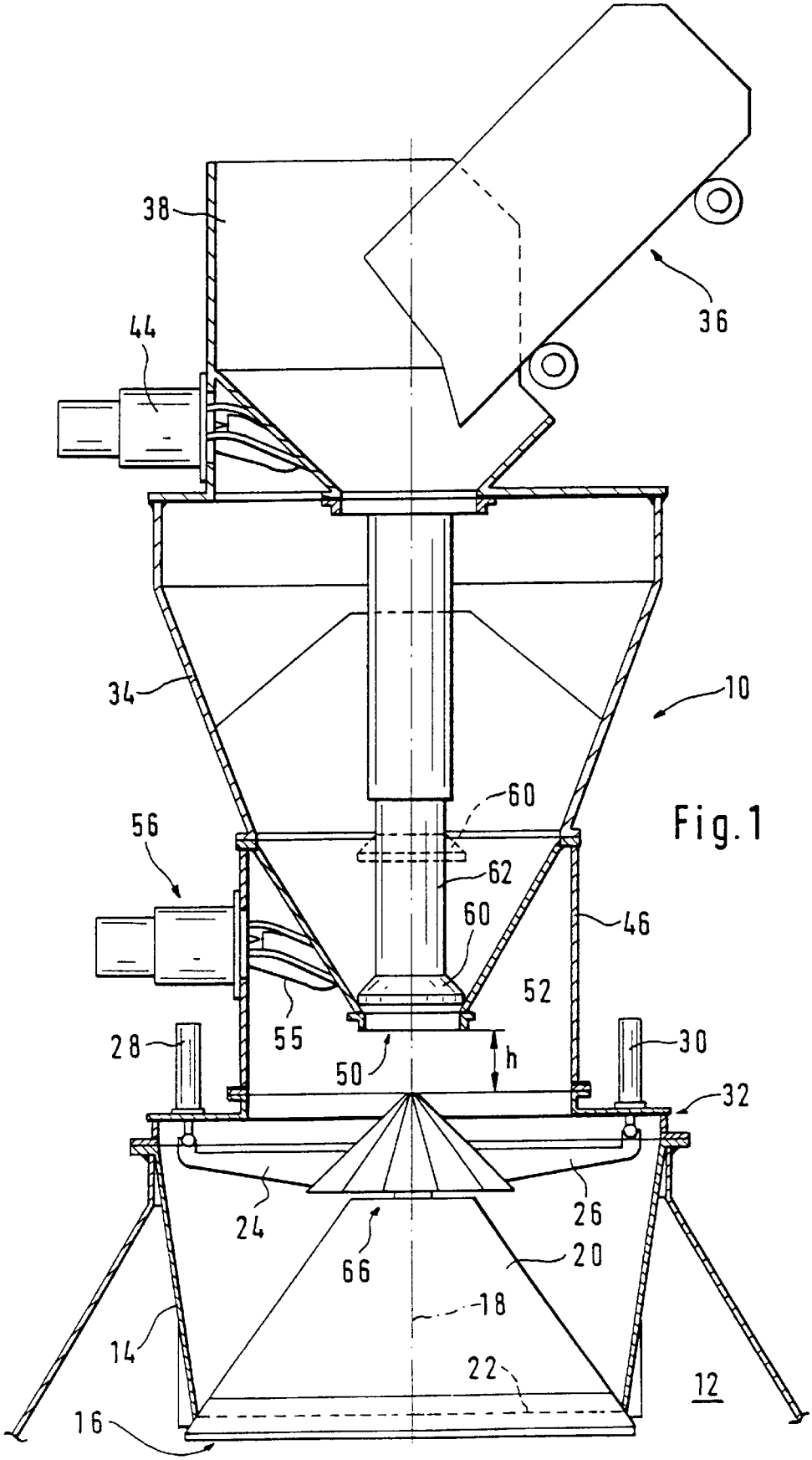
FIGS. 1 and 2 are longitudinal cross-sections through a charging device for a shaft furnace according to the invention; the two planes of the cross-sections make an angle of 90° with each other.
Figure 2:
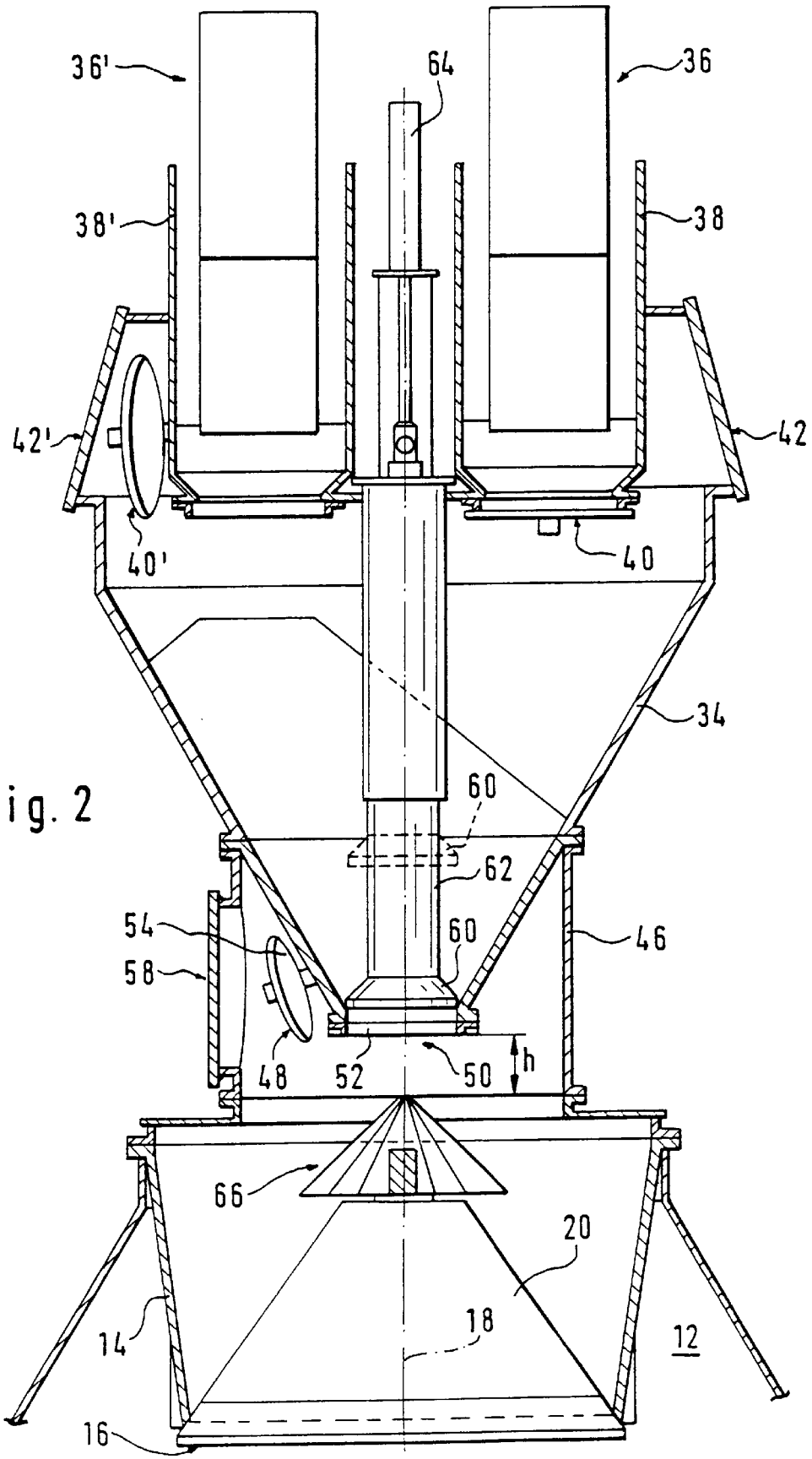

FIGS. 1 and 2 represent a charging device 10 according to the invention, which is mounted above a shaft furnace, for example a blast furnace, denoted by the reference number 12. This charging device 10 comprises a closed flower hopper 14. The lower hopper 14 defines a large-diameter discharge opening 16, which is centred on the axis 18 of the shaft furnace 12. This discharge opening 16 can be blocked off by a large bell 20 (or lower bell 20), which is shown in its blocking position pressing against a peripheral edge 22 of the discharge opening 16 of the lower hopper 14. In order to discharge the material contained in the lower hopper 14, the large bell 20 is lowered vertically, in order to defines with the peripheral edge 22 an annular space with axial symmetry through which the lower hopper 14 can be discharged over the surface of the charge in the shaft furnace (not shown). It will be henceforth understood that, in order to have a symmetrical distribution of the material over the surface of the charge in the shrift furnace, it is essential that the filling of the lower hopper 14 should have axial symmetry. In other words, the profile of the charging in the lower hopper 14 directly affects the spatial composition of the charge in the shaft furnace 12.

The large bell 20 is equipped at its upper part with two lateral supporting arms 24, 26 through which it is supported by two actuators 28, 30. These actuators 28, 30 are mounted on an upper frame 32 of the lower hopper 14. Their actuator rods penetrate the hopper 14 so as to be able to move the large bell 20 axially from its blocking position into its unblocking position and vice versa.

Above the lower hopper 14 is an upper hopper 34, which has an apex angle much smaller than that of the lower hopper 14. This upper hopper 34 is fed in a known way by two skip elevators 36 and 36'. For this purpose the upper hopper 34 is equipped at its upper part with two open feeding tanks 38 and 38' each of which is equipped with a sealing valve 40 and 40', henceforth called upper sealing valves 40 and 40'. In FIG. 2, the upper sealing valve 40 is shown in a blocking position in which it isolates the closed upper hopper 34 in a sealed manner from the feeding tanks 38 and 38'; while the sealing valve 40' is shown in an opera position opposite an inspection door 42' in the upper hopper 34. The reference number 44 in FIG. 1 denotes an actuating mechanism which enables the upper sealing valve 40 to pivot from its open position into its closed position and to apply it firmly against its seating.

At its lower end, the upper closed hopper 34 is connected by a sealed sleeve 46 to the lower hopper 14. In this sealed sleeve 46, a sealing valve 40 is installed below a discharge opening 50 which is defined, on the axis 18 of the shaft furnace, by the lower end of the flow cone of the hopper 34. This sealing valve 48 comprises: a seating 52, surrounding the discharge opening 50 and defining a sealing surface directed towards the hopper 14; a blocking device 54, preferably equipped with a flexible sealing joint; a supporting arm 55 for the blocking device 54; and an actuating mechanism 56 for the blocking device 54. In FIG. 2, the blocking device 54 can be seen in a lateral position in relation to the discharge opening 50. It will be noted that in this lateral position the blocking device and its supporting arm 56 completely unblock the space located below the discharge opening 50 and that the blocking device 54 is opposite an inspection door 58 in the sealed sleeve 46. The actuating mechanism 56 enables the blocking device 54 to pivot, in the absence of a flux of material of course, below the discharge opening 50 and to be applied firmly along the axis 18 with its flexible joint on to the sealing surface of the seating 52.

Installed inside the upper hopper 34 is a material retention bell 60 which, .n its lowered position, blocks a cross-section of the aperture in the flow cone of the upper hopper 34 upstream from the seating 52. In FIGS. 1 and 2, the bell 60 is shown using dashed lines in the raised position, in which it completely clears the aperture cross-section 50. It will be noted that in this raised position the bell 60 affects only the flow of material inside the hopper 34 upstream from the discharge opening 50. It also helps in reducing the phenomenon of the segregation of the material according to its particle size. The bell 60 is attached to a sleeve 62 which is suspended from an actuator 64 mounted axially above the upper hopper 34.

Positioned below the discharge opening 50, at a distance h from it, a distance which is preferably at least of the same order of magnitude as the diameter of the aperture cross-section 50, is a deflecting surface, for example a deflecting cone 66. This cone 66 is oriented with its apex pointing in the direction of the discharge opening 50 and is, at least in its normal position, coaxial with the central axis 18 of the shaft furnace. Its function is to cause the compact flux of material flowing from the upper hopper 34 to disperse. The deflecting cone 66, 5 which in addition can easily be removed and replaced, is therefore manufactured using materials having good shock resistance and good abrasion resistance.

A normal requirement is that the dispersal of the compact flux of material should take place with as perfect an axial symmetry as possible. For this purpose, the deflecting cone may for example be equipped with guide fins extending from the apex to the base and defining between them channels for the flow of the material. In addition, the cone may advantageously be driven so that it rotates around the axis 18 of the shaft furnace.

In some cases, however, it may be advantageous to supply more charge to a particular angular sector of the lower hopper 14 or to rectify residual asymmetries. In this case, it is then sufficient to move the deflecting cone 66 slightly outside its alignment with the axis 18 symmetrically with respect to, the angular sector to which more charge is to be supplied. For this purpose, the deflecting cone 66 can, for example, be displaced in a plane perpendicular to the axis 18. Alternatively, it would also be possible to incline the axis of the deflecting cone 66 with respect to the central axis 18 of the shaft furnace. An adjustable deflecting surface then offers the possibility of altering, almost at will, the distribution of the charging material over the surface of the charge in the shaft furnace 12.

FIGS. 3A, 36 and 4A, 4B make it possible to compare a charging device according to the invention, represented in FIGS. 3A, 3B, with a conventional charging device, without a rotating hopper, represented in FIGS. 4A, 4B. Unlike the device according to the invention, the conventional device comprises a small bell 80 (or upper bell) which can be moved below the discharge opening 82 of the upper hopper 84.

It will first be noted that, in the conventional device of FIGS. 4A, 4B, the diameter of the discharge opening 82 is much greater than the diameter D of the discharge opening 50 in the device according to the invention of FIGS. 3A, 3B This is due to the fact that the width E of the annular space between the bell 80 and the lower edge of the hopper 84 must have a minimum value in order to prevent its blockage by large particles of material.

FIGS. 3A and 4A show the beginning of the discharge of the two hoppers 34 and 84. The profile of the charge in the hoppers 34 and 84 is highly asymmetrical. This asymmetry results from the charging by skips 36, 36'. In the case of FIG. 4A, the bell 80, which serves both as a sealing device and as a material retention device, deflects the trajectories of particles of material already inside the hopper 84 so as to make them diverge radially with respect to the axis 18. In the case of FIG. 3A, the flow cone defined by the upper hopper 34, instead causes the particle trajectories to converge towards the axis 18, so that at the outlet from the discharge cross-section 50 a compact homogeneous flux is established, having an almost perfect axial symmetry. It is only at a distance h from the discharge opening 50, i.e. when the compact flux has already been established, that the focused flux is dispersed by the deflecting surface 66.

The difference between the two devices becomes striking by analysing FIGS. 3B and 4B, in which the upper hopper 34, 84 is nearly empty. In the base of FIG. 36, the axial symmetry of the flux of material is preserved thanks for the focusing of the flux of material at the outlet from the hopper 34. In FIG. 4B, on the other hand, there is no longer any axial symmetry in the flux of material. 11 will be noted that the residual volume of material contained in the hopper 84, (cf. FIG. 4B) is still very large when the flux of material begins to lose its axial symmetry. In the case of FIG. 3B, the residual volume of material contained in the hopper 34 is, on the contrary, very small when the flux of material begins finally to lose its axial symmetry.

Figure 5:
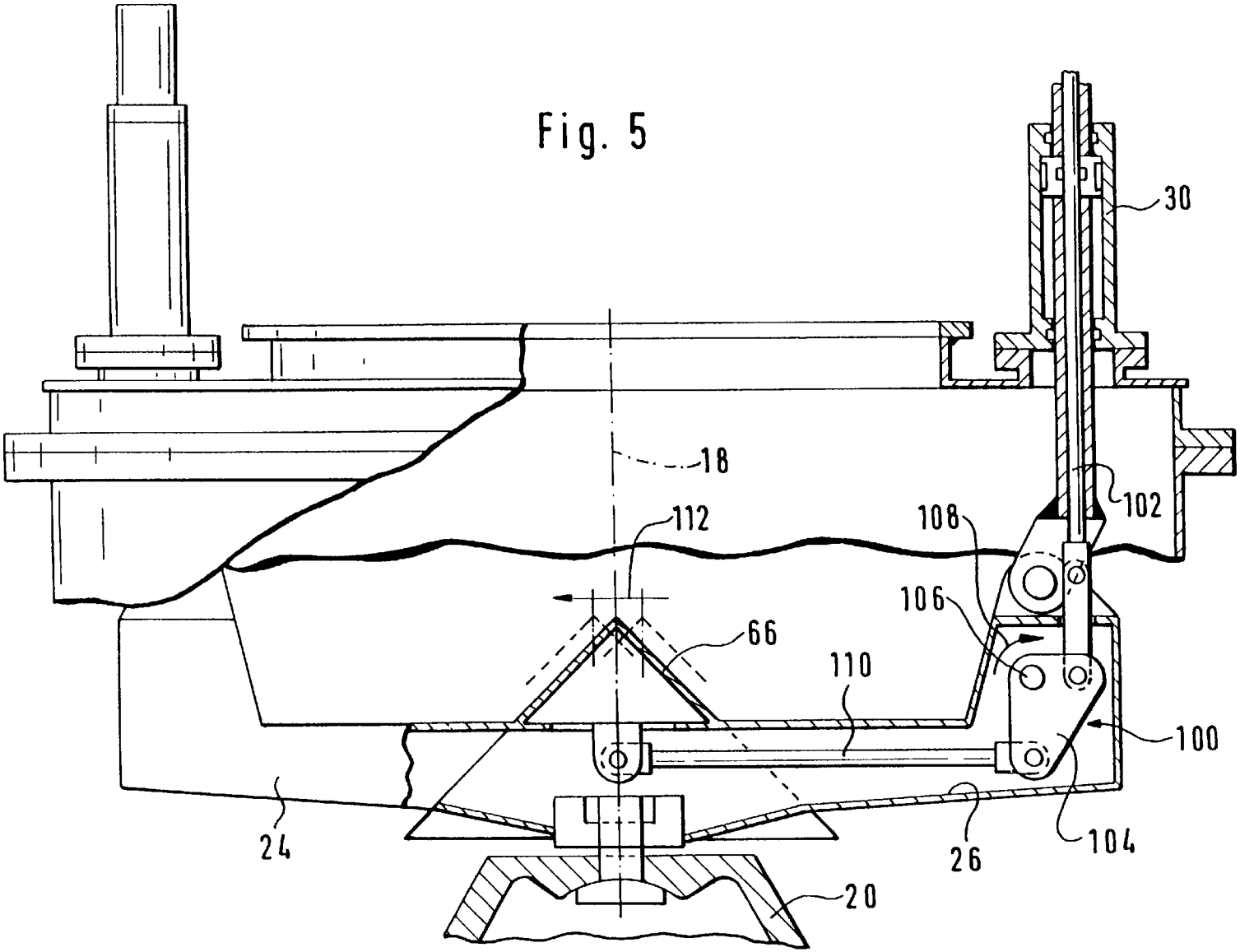
FIG. 5 is a cross-section through a particular mounting of a deflecting surface according to the invention.

FIG. 5 shows a mechanism which allows the positioning of the deflecting cone 66 to be changed with respect to the lower bell. The deflecting cone 66 is guided in translational motion along the supporting arms 24, 26. A set of rods 100 connects the deflecting cone 66 to a rod 102 passing axially through the actuator 30. If the rod 102 is driven further into the furnace, it causes the pivoting component 104 to tilt around its suspension shaft 106 on the supporting arm 126 This tilt of the component 104 takes place in the direction of the arrow 108 and through the intermediary of a rod 110, causes a displacement of the deflecting cone 66 in the direction of the arrow 112. A displacement in the direction opposite to the arrow 112 is obtained by withdrawing the rod 102 further from the furnace. An identical mechanism may be used in order to pivot, if need be, the deflection cone 66 around a pivoting axis perpendicular to the plane of the drawing.

Figure 6:
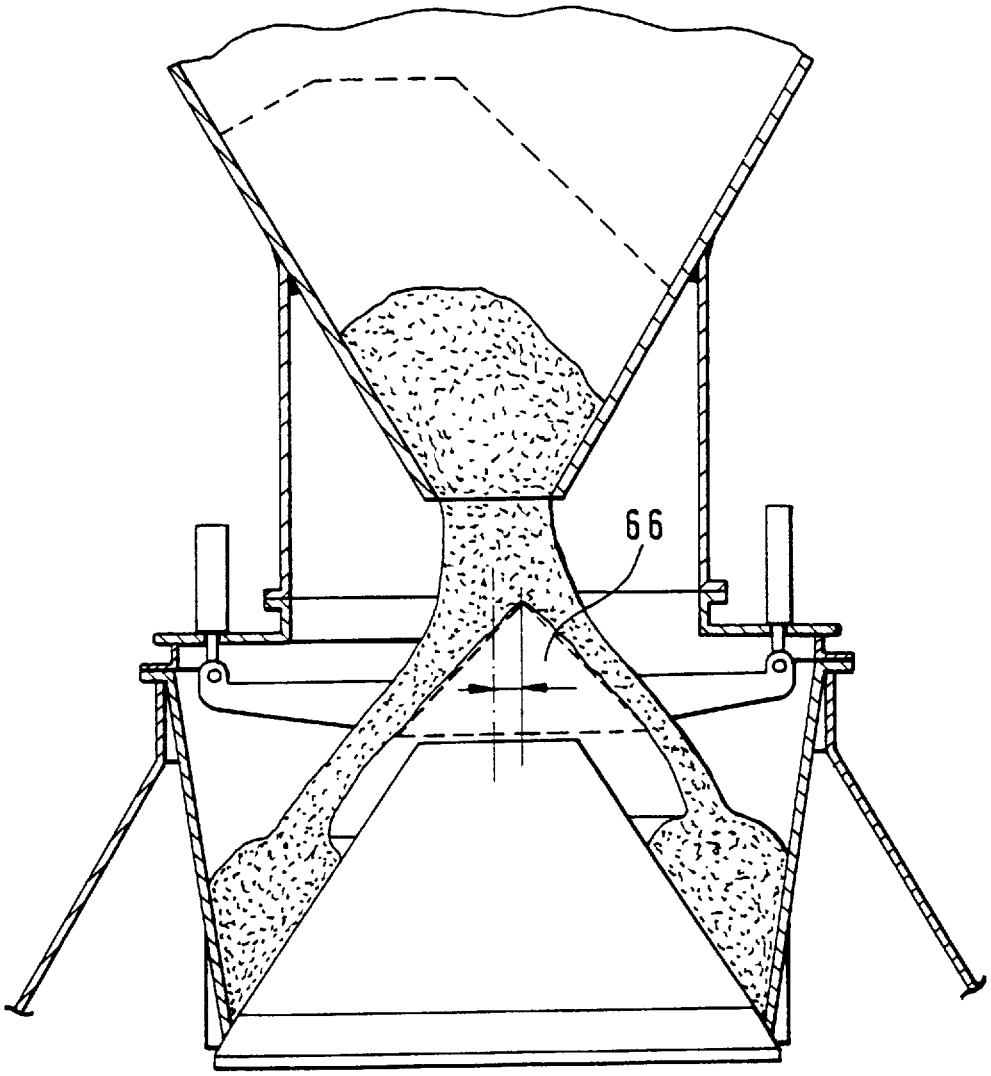
FIG. 6 is a diagrammatic representation of the flow of the material from the upper hopper into the lower hopper, in a charging device for a shaft furnace according to the invention equipped with a deflecting surface according to FIG. 5.

The effect produced by a horizontal off-axis movement of the deflecting cone 66 is described using FIG. 6. In FIG. 6, it can be seen that the deflection cone 66 is shifted to the right in order to direct more material to the left. It will be noted that the displacement of the deflecting cone 66 takes place in the vertical plane which contains the axes of the two charging openings of the upper hopper (=plane of FIG. 2). It has in fact been observed that the residual asymmetries in the surface of the charge in the hopper 14 are a maximum in the plane of FIG. 2 and a minimum in the plane of FIG. 1. The off-axis displacement of the deflecting cone 66 can be continually adjusted during the discharge of the upper is hopper 34. This adjustment may, for example, be obtained by basing it on tests3 carried out for different filling profiles of the upper hopper 34 and for different charging materials.

Figure 7:
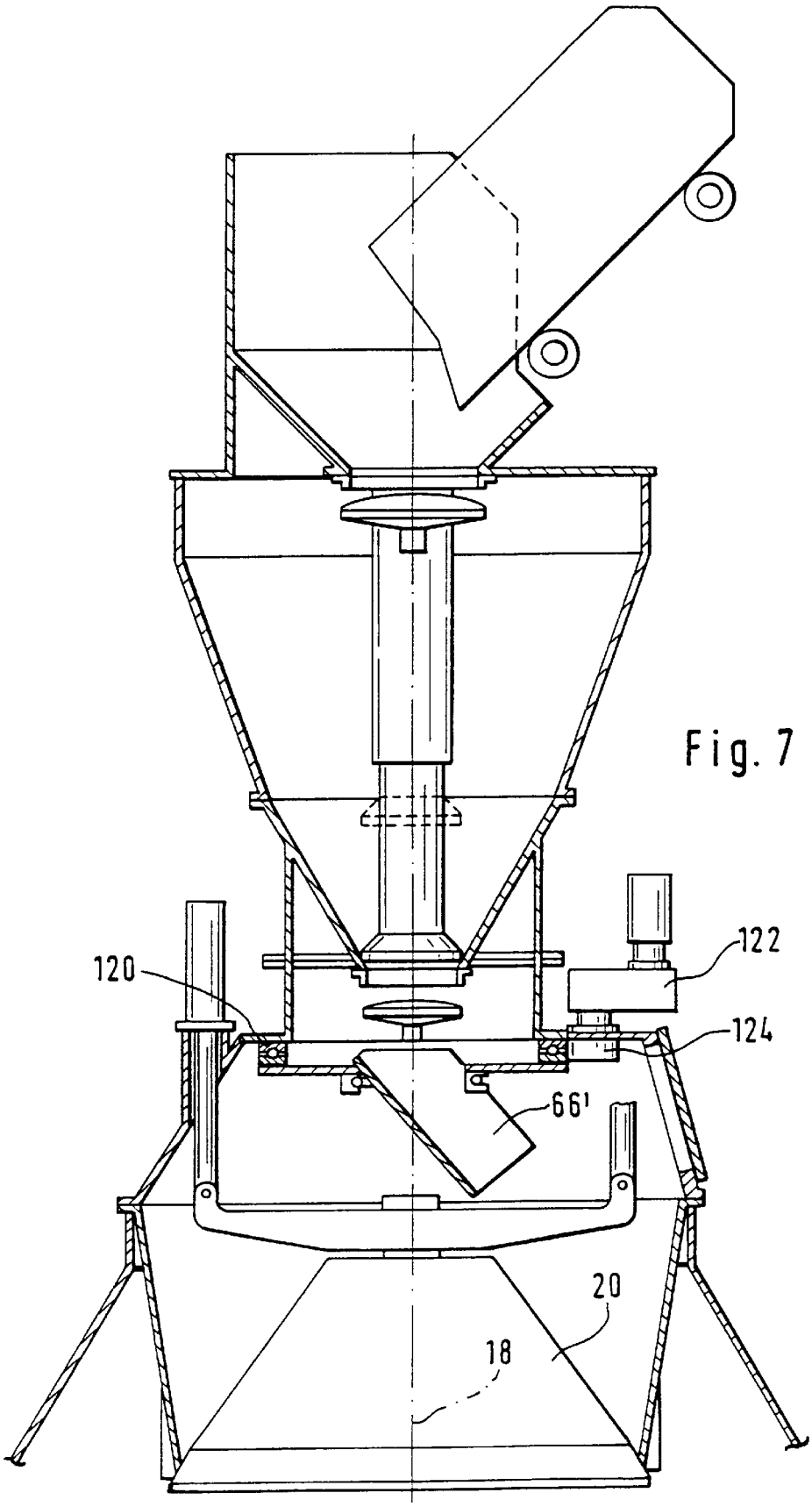
FIG. 7 is a longitudinal cross-section through a charging device for a shaft furnace according to the invention, which is equipped with a deflecting surface which may be driven in rotation about the central axis of the lower bell.

FIG. 7 shows another variant of the embodiment of the deflecting surface according to the invention. In this embodiment, the deflecting surface 66' does not have any axial symmetry, but is suspended above the lower bell 20 so as to be able to rotate about the axis 18. The suspension of this deflecting surface 66' comprises for example a roller ring 120 and a set of gear teeth on this roller ring which engages with a pinion 124 of a drive motor 122. This motor 122 is located outside the furnace. This mechanical drive is particularly simple and can easily be protected against the heat prevailing inside the furnace. It will be appreciated that the implementation with a rotating deflecting surface makes it possible to distribute the focused flux of material with an almost perfect axial symmetry over the lower bell 20.

We claim:

1. Charging device for a shaft furnace comprising a lower hopper (14) defining a discharge opening (16) above a surface of the charge in the shaft furnace, a lower bell (20) having a blocking position in which it blocks off said discharge opening (16) of the lower hopper (14) and an open position in which it is located vertically below said discharge opening (16), means (24, 26, 28, 30) for vertically displacing the lower bell (20) from its blocking position to its open position and vice versa, an upper hopper (34) installed above said lower hopper (14) and connected in a sealed manner to the latter, lower means of blockage (48, 60) connected between the lower hopper (14) and the upper hopper (34) and having a blocking position, in which they isolate the upper hopper (34) in a sealed manner from the lower hopper (14) and retain the charging material in the upper hopper (34), and an open position, in which they allow communications between the upper hopper (34) and the lower hopper (14) and unblock a flux of material flowing from the upper hopper (34) to the lower hopper (14), at least one material feeding device (38, 38') for the upper hopper (34) mounted above the latter, this feeding device being in communication on one side with the atmosphere and on the other side with said upper hopper (34), at least one upper sealing device (40, 40') connected between said feeding devices and the upper hopper (34), in order to be able to isolate the latter In a sealed manner from the atmosphere, characterised in that, in their open position, said lower means of blockage (48, 60) connected between the lower hopper (14) and the upper hopper (34) are: positioned in such a way that they unblock a free central passage (50) substantially coaxial with the axis (18) of the shaft furnace for the flux of material so that this flux is established below the upper hopper (34) in the form of a compact flux of material, in that said means (28, 30, 24, 26) for vertically displacing the lower bell are positioned outside the space occupied by said compact flux of material, and in that, positioned above the lower bell, is a surface for deflecting (66) the compact flux of material so as to make the latter diverge above the lower bell.

2. Device according to claim 1, characterised in that said means of blockage (48, 60) connected between the lower hopper (14) and the upper hopper (34) comprise a sealing device (52, 48) and a material retention device (60), said sealing device (52, 48) being located downstream from said material retention device (60).

3. Device according to claim 2, characterised in that the sealing device (48) comprises a flexible sealing joint.

4. Device according to claim 2 or 3, characterised in that the sealing device (48) is a sealing valve installed below the upper hopper (34).

5. Device according to claim 4, characterised in that the sealing valve comprises a blocking device (54), a seating (52) associated with the blocking device (54), this seating being connected in a sealed manner to said upper hopper (34) and surrounding said space occupied by said compact flux of material, means (56) for moving the blocking device between a lateral position in which it is located outside said space occupied by said compact flux of material, and a blocking position, in which it is located opposite its seating (52), and means for applying the blocking device (54) in its blocking position firmly on to its seating (52).

6. Device according to any one of claims 2 to 5, characterised in that said material retention device comprises several movable blocking devices so as to create a symmetrical discharge opening around the pouring axis.

7. Device according to claim 4, characterised in that said material retention device comprises a bell (60) which can be moved in the upper hopper (34) between a lower position blocking a discharge opening (50) and an upper raised position, in which it unblocks said discharge opening (50).

8. Device according to any one of claims 1 to 7, characterised in that said deflecting surface (66) forms a cone of revolution whose apex is directed towards the upper hopper (34) and whose axis is coaxial with the axis of the compact flux of material.

9. Device according to claim 8, characterised in that the cone of revolution (66) is fitted with guide fins extending from the apex to the base of the cone so as to define flow channels for the material.

10. Device according to any one of claims 1 to 9, characterised by a mechanism (100, 102) capable of varying the positioning of said deflecting surface (66) above said lower bell.

11. Device according to claim 10, characterised in that said mechanism comprises a set of rods (100) capable of moving the deflecting surface (66) in a substantially horizontal plane.

12. Device according to claim 10, characterised in that said mechanism comprises a set of rods (100) capable of pivoting the deflecting surface around a substantially horizontal axis.

13. Device according to any one of claims 1 to 9, characterised by a mechanism (120) for suspending said deflecting surface (66') above said lower bell (20), which is designed in such a way that said deflecting surface (66') can be driven in rotation around the central axis of the lower bell (20), and a driving mechanism (124, 126) capable of driving said deflecting surface (66') in rotation.

14. Device according to claim 13, characterised in that said suspension mechanism comprises a roller ring (120), and said driving mechanism comprises a set of gear teeth on the roller ring and a pinion (124), located inside the furnace, and a drive motor (122) for the pinion (124), located outside the furnace.

* * * * *